US006190145B1

(12) United States Patent
Fujioka et al.

(10) Patent No.: US 6,190,145 B1
(45) Date of Patent: Feb. 20, 2001

(54) SCROLL FLUID MACHINE

(75) Inventors: Tamotsu Fujioka; Tohru Satoh, both of Yokohama (JP)

(73) Assignee: Anest Iwata Corporation, Tokyo (JP)

( * ) Notice: Under 35 U.S.C. 154(b), the term of this patent shall be extended for 0 days.

(21) Appl. No.: 09/419,081

(22) Filed: Oct. 15, 1999

(30) Foreign Application Priority Data

Oct. 15, 1998 (JP) ..... 10-293139

(51) Int. Cl.[7] ..... F01C 1/02
(52) U.S. Cl. ..... 418/55.1; 418/101; 417/371
(58) Field of Search ..... 418/55.1, 101; 417/371

(56) References Cited

U.S. PATENT DOCUMENTS

| | | | | |
|---|---|---|---|---|
| 3,134,369 | | 5/1964 | Schlor . | |
| 5,417,554 | | 5/1995 | Kietzmann et al. . | |
| 5,551,846 | * | 9/1996 | Taylor et al. | 418/55.1 |

FOREIGN PATENT DOCUMENTS

| | | | | |
|---|---|---|---|---|
| 360048 | | 3/1990 | (EP) . | |
| 58-146894 | | 10/1983 | (JP) . | |
| 3-130588 | * | 6/1991 | (JP) | 418/55.1 |
| 3-145588 | * | 6/1991 | (JP) | 418/55.1 |
| 5-071472 | * | 3/1993 | (JP) | 418/55.1 |
| 6-129383 | * | 5/1994 | (JP) | 418/101 |
| 7-29269 | | 7/1995 | (JP) . | |
| 10-26090 | | 1/1998 | (JP) . | |
| 63-100294 | * | 5/1998 | (JP) | 418/55.1 |

* cited by examiner

*Primary Examiner*—Thomas Denion
*Assistant Examiner*—Theresa Trieu
(74) *Attorney, Agent, or Firm*—Evenson, McKeown, Edwards & Lenahan, P.L.L.C.

(57) ABSTRACT

The present invention is to offer a scroll fluid machine of which the scroll machine proper is cooled sufficiently and effectively and characterized in that, a tubular jacket 26 is provided, said tubular jacket surrounds the outer circumferential surface of a motor 15(motor housing 13) keeping some distance from said surface and has an annular opening 17a on said motor facing to said scroll machine proper side, from which opening cooling gas induced by a cooling fan 16 is taken in, and a passage 19 connecting to the cooling space 17 formed by said outer circumferential surface of the motor and said tubular jacket is provided to guide and introduce said taken-in cooling gas to said scroll machine proper in the direction crossing the longitudinal direction of the rotation shaft of said motor. Thus, the back side of the scroll disk of said scroll machine proper is cooled by the cooling gas flowing in one direction behind the scroll disk.

7 Claims, 5 Drawing Sheets

SCROLL FLUID MACHINE

BACKGROUND OF THE INVENTION

1. Field of the Invention

The present invention relates to a scroll fluid machine of which the scroll machine proper is forced cooled by letting cooling gas taken in by a cooling fan flow in one direction.

2. Description of the Related Art

A variety of scroll machines which are forced cooled by cooling fan are known. The published Unexamined Japanese Patent Application No. Hei 10-26090 is one of them.

According to the disclosure, a scroll body composed of a stationary scroll and a revolving scroll is coupled to an end of the rotation shaft of an electric motor, a cooling fan is coupled to the other end of the rotation shaft, a guide ring surrounds the outer circumferential surface of the motor with some gap between them to form a passage, and a cooling gas taken in by the fan passes through the passage and cools forcibly the revolving scroll and its bearing.

By the prior art described above, there is a problem that the cooling is insufficient because, although the back side of the revolving scroll and its bearing is forced cooled, the back side of the stationary scroll is not forced cooled.

Further, there is also a problem that the cooling gas which has cooled the back side of said revolving scroll and its bearing flows out through an exhaust opening in the direction perpendicular to that of inflow and induces high flow loss of the cooling gas.

SUMMARY OF THE INVENTION

The object of the present invention is, in view of the fact as mentioned above, to offer a scroll fluid machine of which the cooling of the scroll body is performed sufficiently and efficiently.

The present invention cited in claim 1 is characterized in that, in a scroll fluid machine in which the scroll machine proper is driven by a rotation shaft of an electric motor and forced cooled by a cooling gas taken in by a cooling fan, which cooling gas flows in one direction,

- a tubular jacket is provided to surround at least a part of the outer circumferential surface of the electric motor keeping some distance from the outer circumferential surface to form an annular passage for cooling gas taken in by a cooling fan, which cooling gas flows into the annular passage from an annular aperture formed between the outer circumferential surface and an end of said tubular jacket;
- a passage connecting to the annular passage is formed to guide and send out the cooling gas to a side of the scroll machine proper in a direction crossing the longitudinal direction of the rotation shaft; and
- the cooling gas flows from one lateral side to the other lateral of the scroll machine proper to forcibly cool the back side of the scroll disk.

The scroll fluid machine of the present invention is applicable not only for compression of fluid but as vacuum pump. The electric motor may be an inner rotor type or outer rotor type as far as the driving force of said motor is taken out through a rotation shaft which can be connected to drive the scroll machine proper.

Further, the scroll machine proper may be one which is composed of a stationary scroll and a revolving scroll, such as, for example, a single lap scroll type or a double laps scroll type, or a combination of a driving scroll and a follower scroll.

The taken-in cooling gas is introduced to the scroll machine proper in a direction crossing the longitudinal direction of the rotation shaft and flows on the back side surface of the scroll disk, that is the back side surface of the compression chamber of scroll, in one direction from one side to the other side of the scroll disk cooling forcibly the scroll disk, and so sufficient cooling is performed efficiently.

It is also an effective means of the present invention to compose so as to cool the back side of the disk of one scroll and at the same time cool the backside of the disk of the other scroll which is disposed opposing the former scroll to form a compression chamber by letting a cooling gas flow in one direction from one lateral side to the other lateral side of the scrolls.

By means of this construction, as the taken-in cooling gas is introduced to the scroll machine proper in a direction crossing the longitudinal direction of the rotation shaft and the back side of the disk of one scroll and at the same time the back side of the disk of the other scroll which is disposed opposing the former scroll to form a compression chamber are cooled by letting the cooling gas flow in one direction from one lateral side to the other lateral side of the scrolls, sufficient and efficient cooling is performed.

Further, as the back side of both disks which form a compression chamber are cooled, even the cooling gas after cooling the motor when passing the annular cooling passage formed between the outer circumferential surface of the motor and an tubular jacket can cool the scroll machine proper effectively.

It is also an effective means of the present invention to compose so that both scrolls have a number of cooling fins on their back surfaces and a connecting device is provided behind one of the scrolls toward the motor side to connect the scroll to the rotation shaft of the motor. By means of this construction, the cooling fins can be provided on the back surface of the scroll disk between the disk and the connecting device, because the rotation shaft of the motor is not directly connected to the scroll but connected through the connecting device, which eliminates the necessity of providing a boss for the connection and makes it possible to secure the space for providing cooling fins in the central portion of the disk of the scroll, and so the center portion of the scroll where heat generation is high is cooled effectively.

It is also an effective means of the present invention to compose so that one end of the rotation shaft of the motor is connected to the scroll machine proper and the other end is provided with a cooling fan in the space formed by upper and lower covers which also form a passage for guiding the cooling gas, and the fan rotates with rotation of the motor to forcibly cool the scroll machine proper; or to compose so that a fan is placed at the lateral side opposite to the lateral side of the scroll machine proper where the cooling gas is introduced in the back side of the scroll disk.

It is also an effective means of the present invention to compose so that the tubular jacket is shaped like a bell mouth at the inlet and corners of the passage to guide the cooling gas to the scroll machine proper are rounded to reduce the flow loss of the cooling gas to attain efficient cooling.

It is also an effective means of the present invention to compose so that the flow diverting means is provided at the outlet of the guide passage to divert the flow to the back side of s scroll disk and to that of the other scroll disk.

By the flow diverting means the cooling gas is distributed properly to the back side of a scroll disk and to that of the other scroll disk, effecting balanced and efficient cooling.

Figure 1:
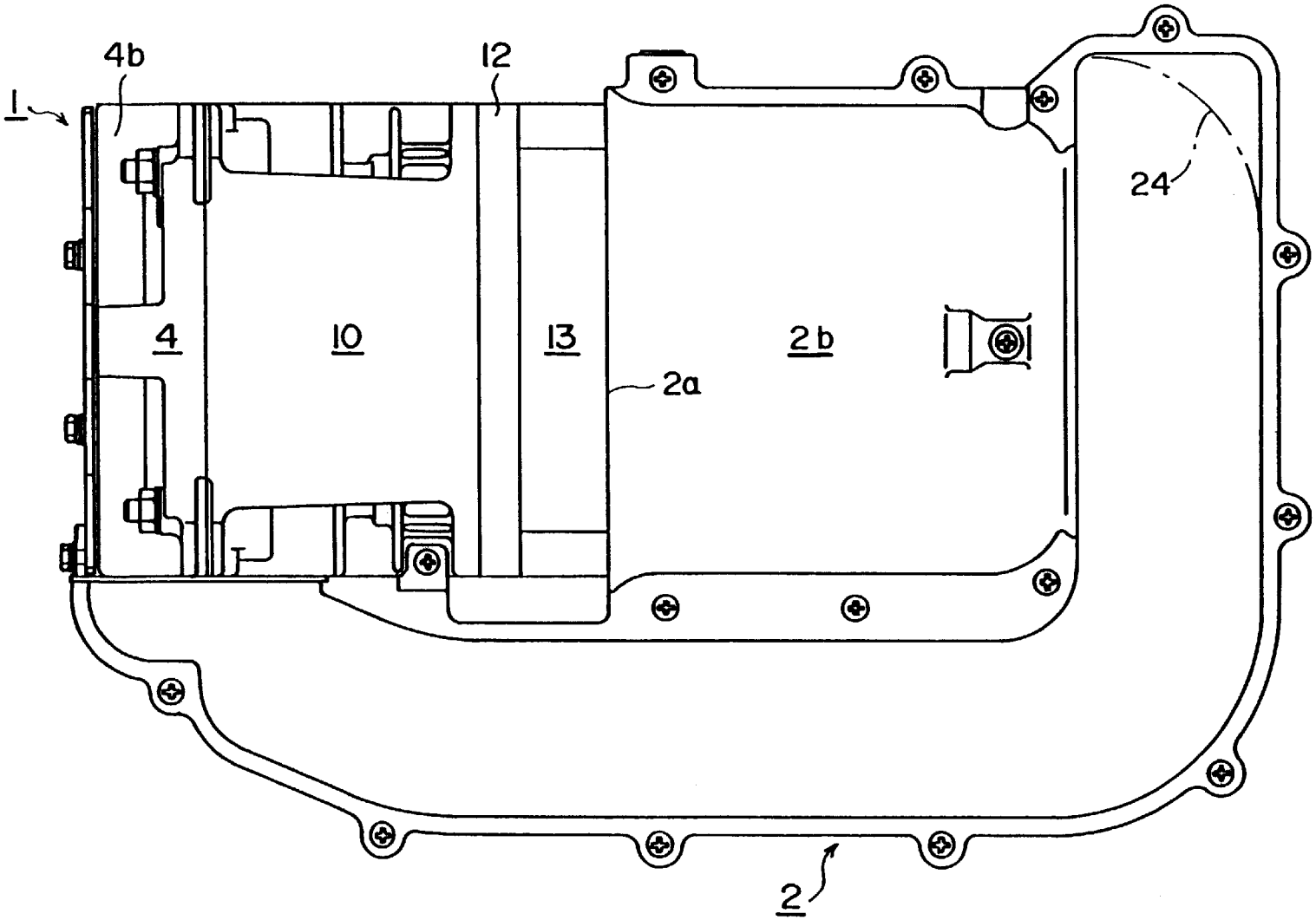
FIG. 1 is a plan view of an embodiment of a scroll fluid machine of the present invention.

In the drawings reference numeral 1 denotes scroll machine proper, 2 upper cover, 3 lower cover, 9 rotation shaft, 10 housing of scroll machine proper, 13 motor housing, 17 annular passage, 19 guide passage, 26 tubular jacket.

DETAILED DESCRIPTION OF THE PREFERRED EMBODIMENTS

Preferred embodiments of the present invention will now be described with reference to the accompanying drawings. It is intended, however, that dimensions, materials, and shapes of the constituent parts, relative positions thereof and the like in the following description and in the drawings shall be interpreted as illustrative only not as limitative of the scope of the present invention.

Figure 2A:
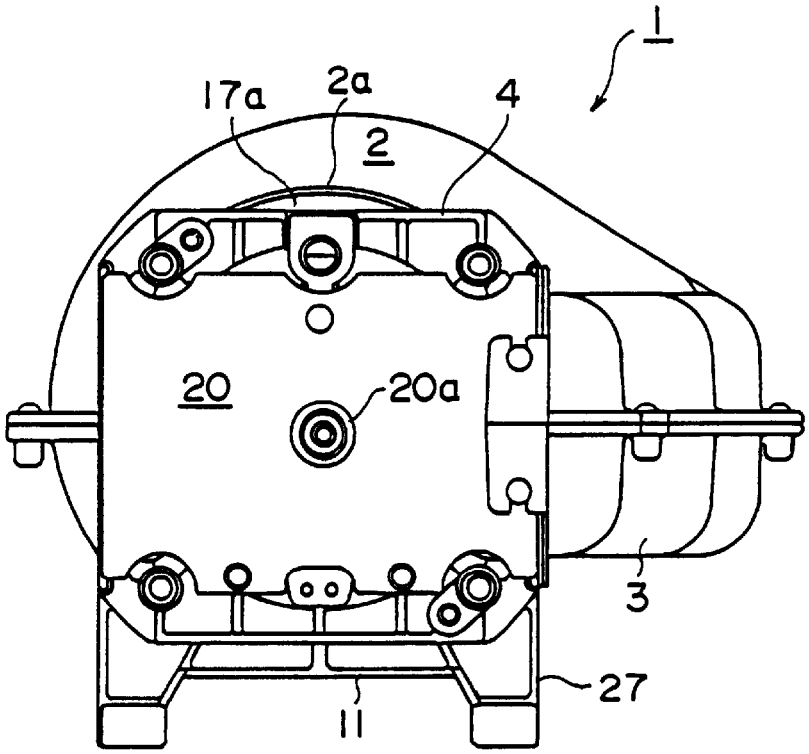
FIG. 2A, is a left side view.
Figure 2B:
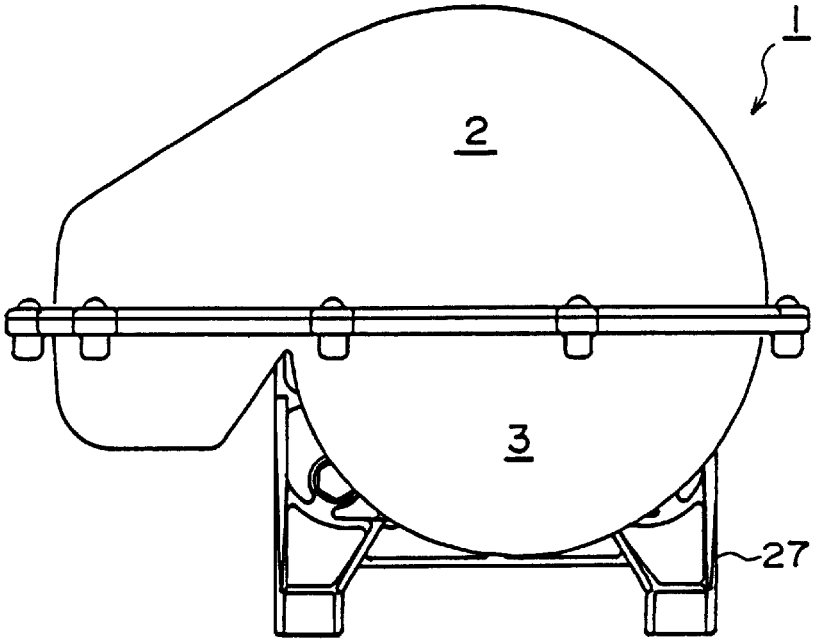
FIG. 2B is a right side view of the scroll fluid machine of FIG. 1.
Figure 3:
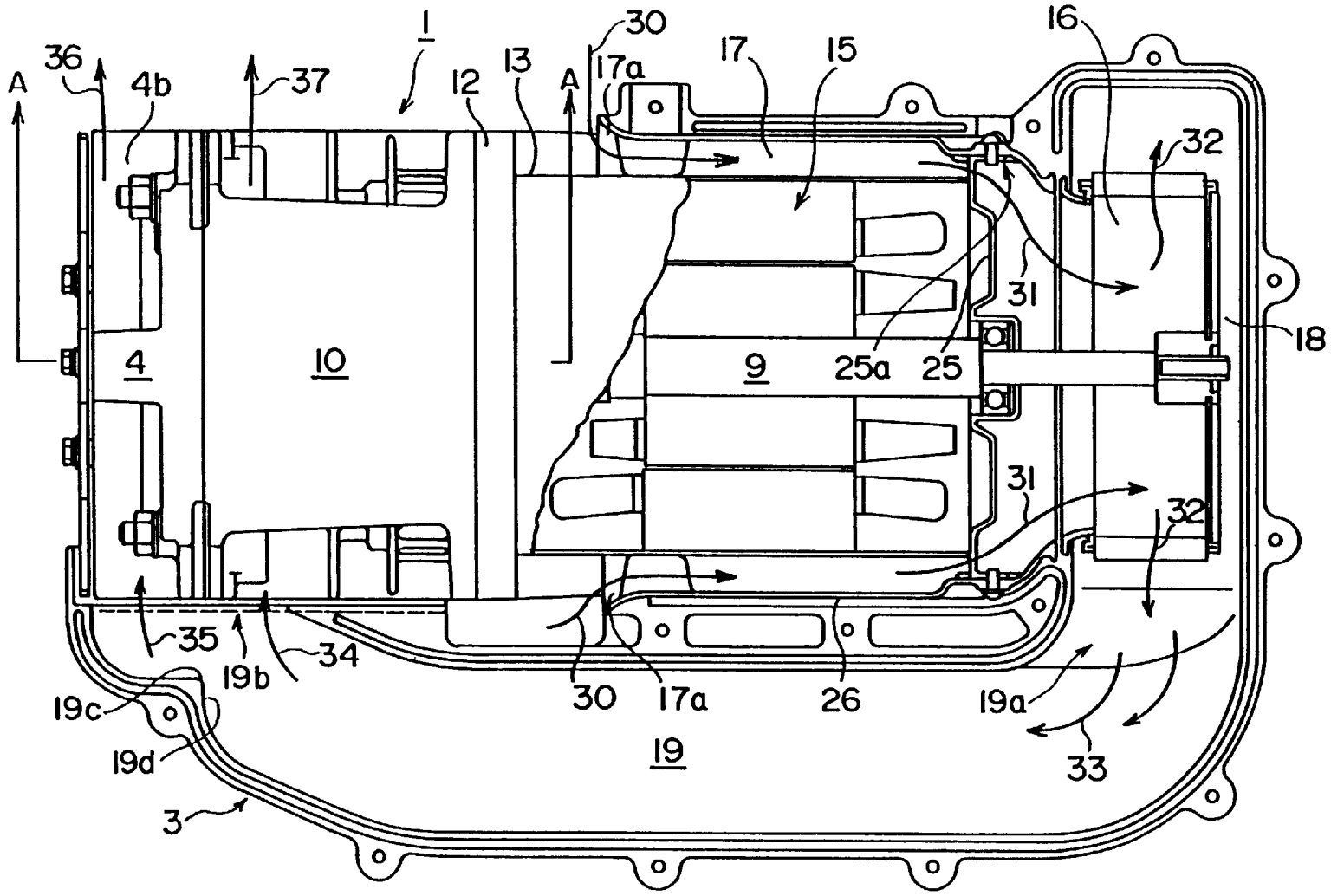
FIG. 3 is a local sectional plan view of the scroll fluid machine of FIG. 1.
Figure 4:
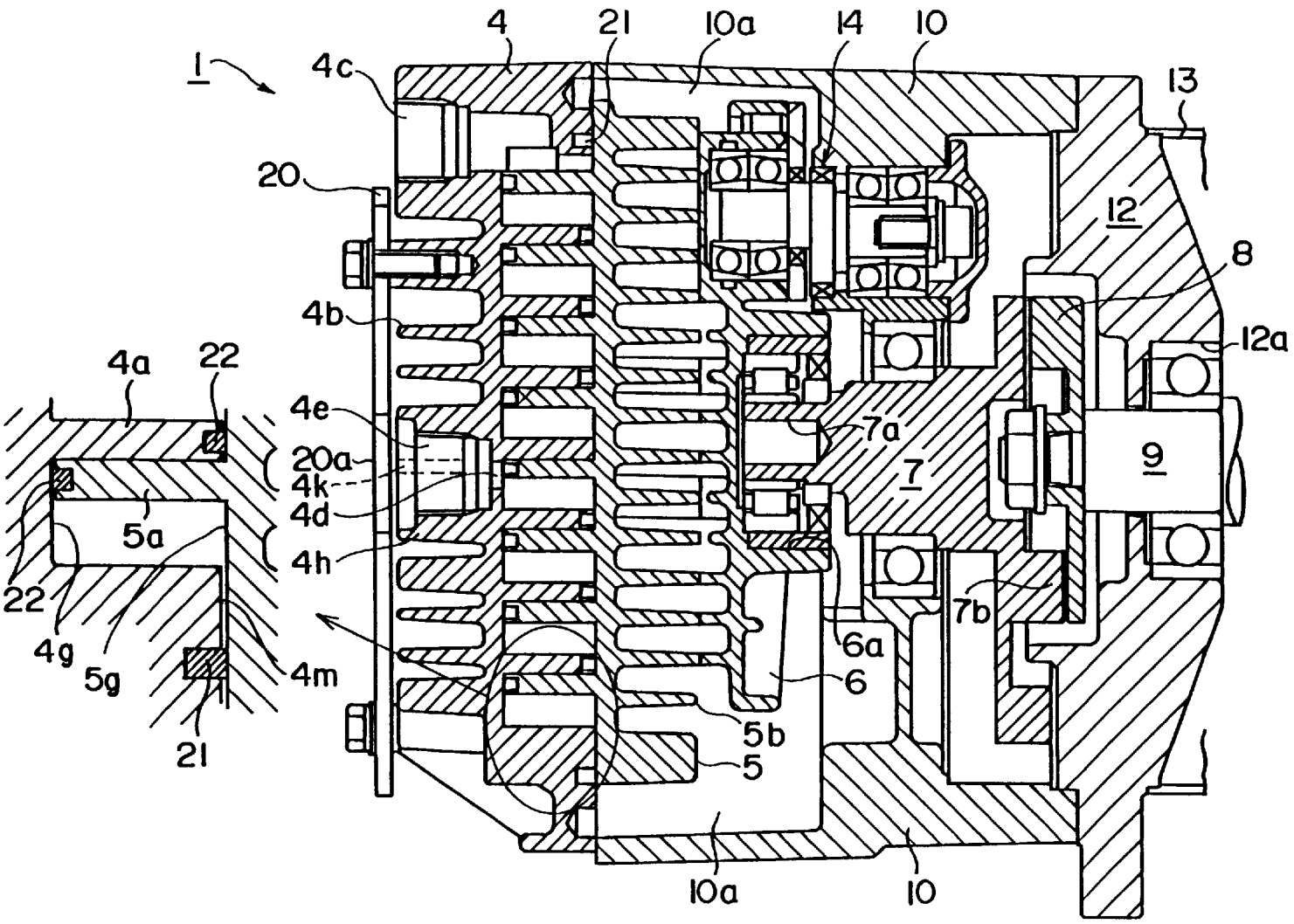
FIG. 4 is a section taken along lines A—A in FIG. 3.
Figure 5:
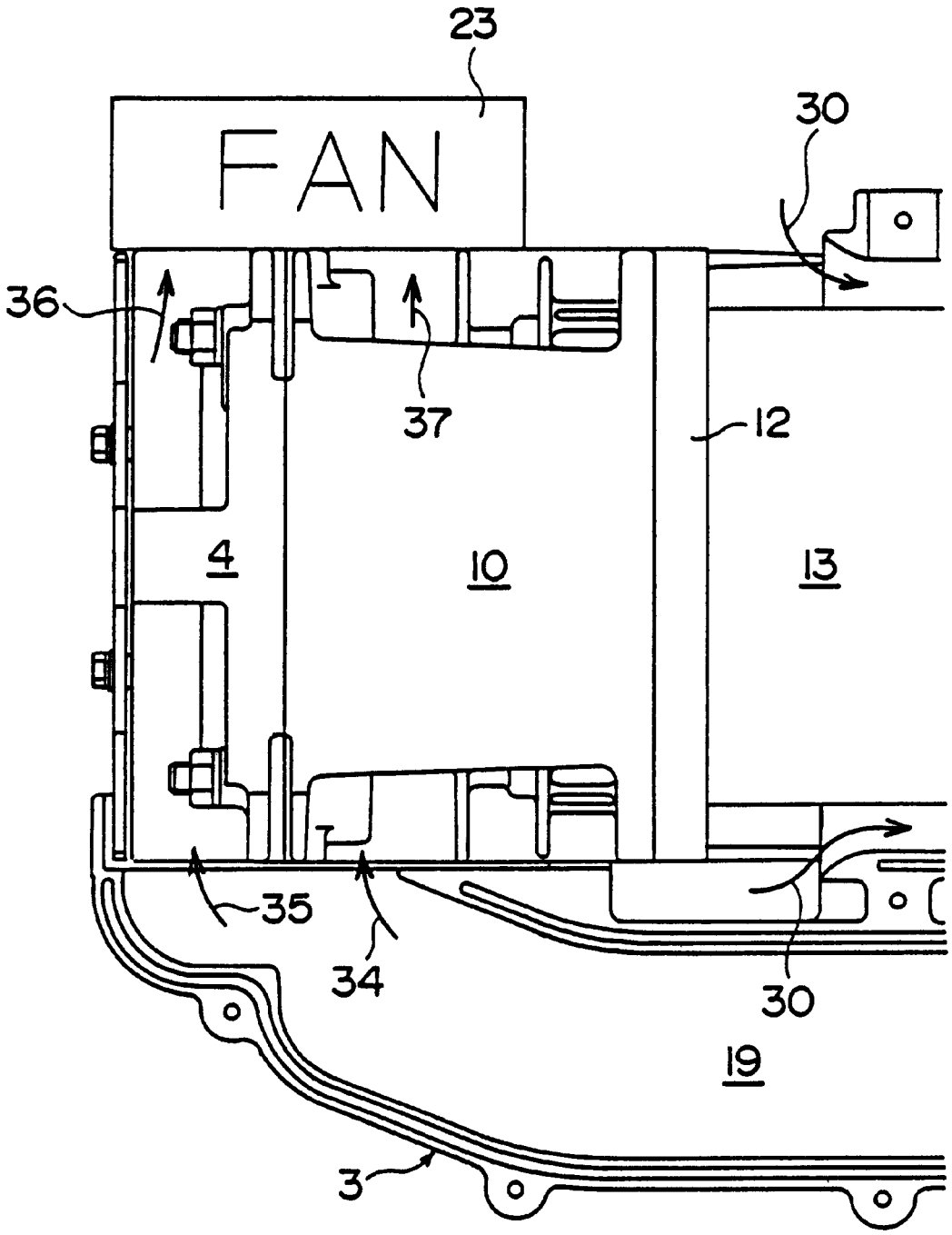
FIG. 5 is another embodiment of a scroll fluid machine of the present invention.

FIG. 1 is a plan view of an embodiment of a scroll fluid machine of the present invention showing the placement of constituent machines and parts, FIG. 2A and FIG. 2B are a left and a right side view respectively of the scroll fluid machine of FIG. 1 showing external view, FIG. 3 is a local sectional plan view of the scroll fluid machine of FIG. 1 showing the flow of cooling gas, FIG. 4 is a section taken along lines A—A in FIG. 3 showing the longitudinal section of the scroll machine proper of FIG. 1, and FIG. 5 is another embodiment of a scroll fluid machine of the present invention showing the placement of a cooling fan.

In FIG. 1, FIG. 2A and FIG. 2B, 1 is a scroll machine proper, 2 is an upper cover, 13 is a motor housing, 2*b* is the arciform part of the upper cover 2, 12 is a supporter plate, 10 is a housing of the scroll machine proper 1, 4 is a stationary scroll having cooling fins 4*b* and fixed to the housing 10, 3 is a lower cover fixed to a base 27, 17*a* is an inlet opening for cooling gas, and 20 is a front cover with an opening 20*a* in the center.

In FIG. 3, said upper cover 2 is removed and an electric motor 15 is shown in sectional view. An annular jacket 26 surrounds the motor housing 13, extends to the suction opening of a cooling fan 16 and is fixed to a supporter plate 25.

The lower cover 3 and the upper cover 2 form when assembled a space 18 for accommodation of the fan 16 and a guide passage 19 for guiding the cooling gas to the scroll machine proper.

The rotation shaft 9 of the motor 15 is rotationally supported by a pair of bearings in the supporter plate 12 and the supporter plate 25, and the cooling fan 16 is fixed at the end of the rotation shaft 9 in the rear (right side) of said motor 15.

The cooling fan 16 is located in the space 18 formed by the upper cover 2 and the lower cover 3, and when rotated by the motor 15 induces air from the annular aperture 17*a* through the annular passage 17 and apertures formed in the supporter plate 25 in the outside part of the motor housing to the suction opening of the fan 16 as indicated by arrows 30 and 31.

The cooling air blown out from the fan 16 radially outwardly flows to the guide passage 19 passing the corner 19*a* as indicated by arrows 32 and 33 and flows out from the guide passage 19 to the scroll machine proper at the outlet of the guide passage 19 as indicated by arrows 34 and 35.

The cooling gas flowing along the outer side wall of the guide passage 19 turns its flow direction at the outlet part along a projected part 19*d* of the wall, but the succeeding inner side flow push the outer side flow, and as a result the flow quantity is evenly distributed to flow in the lateral side of the back sides of both scroll disks of the scroll machine proper as indicated by arrows 34 and 35.

Next, the scroll machine proper 1 will be described referring to FIG. 4 which shows a section taken along lines A—A in FIG. 3. In FIG. 4, the scroll machine proper comprises a stationary scroll 4, a revolving scroll 5, a housing 10, an auxiliary crank carrier 6, a drive shaft 7, and a support plate 12. The stationary scroll 4 which is fixed to the housing 10 has a spiral-shaped lap 4*a* embedded on the sliding surface 4*g* of the scroll disk and a number of cooling fins 4*b* on the back side of the disk extending in the direction perpendicular to the sheet of the drawing, that is, in the lateral direction.

The revolving scroll 5 has a spiral-shaped lap 5*a* embedded on the sliding surface 5*g* of the scroll disk and a number of cooling fins on the back side of the disk extending in the direction perpendicular to the sheet of the drawing, that is, in the lateral direction.

In the stationary scroll 4 are bored in the boss near the center of the disk a discharge port 4*d* penetrating the disk and a screw hole 4*e* connecting to the discharge port 4*d,* and an inlet port 4*c* at the perimetral part. From the boss near the center of the disk extends the cooling fin 4*k*. A front cover 20 having an opening 20*a* in the center is fixed to the stationary scroll.

Fluid taken in from said inlet port 4*c* and compressed in the scroll chamber formed by spiral laps 4*a,* 5*a* and sliding surfaces 4*g,* 5*g* of both stationary and revolving scrolls 4, 5 is discharged from the discharge port 4*d* and flows out through a pipe, not shown, connected to the screw port 4*e*.

The top surfaces of the laps 4*a* and 5*a* are grooved for insertion of tip seals 22 made of such as fluorine group resin having self lubricating property to seal the fluid. On the perimetral part of the inside surface 4*m,* which is level with the top surface of the lap 4*a,* is grooved around the lap 4*a* for insertion of a dust seal 21 made of such as fluorine group resin having self lubricating property to prevent intrusion of dust.

The drive shaft 7, having an offset potion 7*a* at the left end with its right end coupled to said rotation shaft 9 through a coupling 8 fixed to the end of the rotation shaft 9, is journalled on a bearing in the housing 10 and supports on the offset portion 7*a* the auxiliary crank carrier 6 by means of a bearing fit in the central hub of the auxiliary crank carrier 6. Three auxiliary crank 14, each having an offset portion of which the offset is same as that of the offset portion 7*a* of the drive shaft, are journalled on bearings in the housing 10 at circular intervals of 120° and the three offset portions of three auxiliary cranks 14 support the auxiliary crank carrier 6 by means of bearings in three bosses formed with circular intervals of 120° near the perimetral part of the auxiliary crank carrier 6 which is fixed to the revolving scroll on the back side behind the cooling fins 5*b*.

By the construction as described above, the auxiliary crank carrier, consequently the revolving scroll, revolve or orbit around the center of rotation of the drive shaft 9 with rotation of the drive shaft 9 without self rotation, the laps 4*a* and 5*a* intermesh each other, and the fluid taken in from said inlet port 4*c* is compressed toward the center to be discharged from said discharge port 4*d*.

As the motor 15 drive the scroll machine proper 1 the cooling fan 16 attached to the rotation shaft 9 rotates and the cooling air is taken in from annular opening 17*a*. The cooling air then proceeds in the annular passage 17 cooling the motor 15 to the cooling fan to be sucked in, blown out cooling air from the fan 16 proceeds through the passage 19 to the outlet 19*b* and flow from the lateral side of the scroll machine proper 1 in the back side of the stationary and revolving scroll disks as indicated by arrows 34 and 35 and out flow as indicated by arrows 37 and 36 cooling the both scrolls from the back sides by the medium of cooling fins.

The flow loss in the annular passage 17 and in the guide passage 19 is small in those passages and as a result cooling gas is supplied efficiently for cooling the scroll machine proper.

FIG. 5 shows another embodiment of the present invention.

Difference from the embodiment described above is that a suction cooling fan is placed at the cooling gas exhaust side of the scroll machine proper not in the space 18.

In this case it is preferable to round the corner of the space 18 as indicated by a chain line 24 in FIG. 1 to reduce flow loss.

Heretofore, although preferable embodiments have been described referring to a single lap scroll type of which the revolving scroll has single lap, the present invention is applicable to a double lap scroll type which comprises a revolving scroll with laps on both side of its center disk and two stationary scrolls in both side of the revolving scroll for cooling the both back sides of the two stationary scrolls.

In the case of double scroll type, cooling of the back side of revolving scroll is possible by providing a cooling passage, or passages in the center disk of larger thickness, or by composing a revolving scroll so that two disks having a scroll lap on one side of each disk are combined with each other on the back side opposite to the lap side keeping some distance between the back surface of the disks to secure a cooling gas passage. Thus, not only the back sides of two stationary scrolls but also the back sides of disks of a revolving scroll can be cooled effectively.

Although the inlet of cooling gas 17*a* is located near the boundary between the scroll machine proper 1 and the motor 15 in FIG. 3, the tubular jacket 26 may be extended toward the scroll machine proper 1 or drawn back toward the motor 15. It is essential only that the proper length of the annular passage 17 for cooling the motor 15 be secured.

The cooling gas may be taken in from openings provided on the circumferential surface of the tubular jacket 26 and arciform part of the upper 2 and lower cover 3.

Although in the embodiments described above the tubular jacket 26 keeps some distance all over the circumference from the outer circumferential surface of the motor 15 and the cooling gas contacts all over the outer circumferential surface of the motor 15, it may be acceptable to form a jacket so that it forms several tunnels on the said outer surface of the motor 15 and the cooling gas contacts said outer surface not all over the circumference but partly to secure the required cooling area for cooling the motor 15.

As described heretofore, according to the present invention of claim 1, the taken-in cooling air is introduced from a lateral side of the scroll machine proper in a direction crossing the longitudinal direction of the rotation shaft and forcibly cools the scroll disk from the backside, and sufficient cooling is performed efficiently.

Even the cooling gas after cooling the motor in the passage surrounding the motor can cool the scroll machine proper effectively, since the cooling gas forcibly cools the back sides of the scroll walls.

What is claimed is:

1. A scroll fluid machine in which a scroll machine proper is driven by the rotation shaft of a motor and is forced cooled by flowing a cooling gas taken in by a cooling fan in one direction, wherein;

a tubular jacket surrounding at least a part of the outer circumferential surface of said motor keeping some distance from the outer circumferential surface of said motor is provided and an inlet opening for taking in cooling gas by said cooling fan is arranged;

a passage connecting to the cooling space formed between the outer circumferential surface of said motor and said tubular jacket for guiding and introducing said cooling gas taken in from said inlet opening to a lateral side of said scroll machine proper in a direction crossing the longitudinal direction of said rotation shaft is composed; and said cooling gas flows from a lateral side to the other lateral side of said scroll machine proper and forcibly cools the back side of a scroll disk of said scroll machine proper.

2. A scroll fluid machine according to claim 1, wherein the back side of a scroll disk and also the back side of the other scroll disk disposed opposing to the former scroll disk to form a fluid compression chamber are cooled by the cooling gas flowing from a lateral side of the scroll disks.

3. A scroll fluid machine according to claim 1, wherein the back side of a scroll disk and the back side of the other scroll disk include a number of cooling fins and said former scroll disk is provided with a connecting device on the back side toward said motor to be connected to the rotation shaft of said motor.

4. A scroll fluid machine according to claim 1, wherein the rotation shaft of said motor is connected to said scroll machine proper at one end and connected to a cooling fan at the other end, and said fan is rotated with rotation of said motor to forcibly cool said scroll machine proper.

5. A scroll fluid machine according to claim 1, wherein said cooling fan is placed at the lateral side opposite to the lateral side where cooling gas is introduced in the back side of the scroll disk of said scroll machine proper.

6. A scroll fluid machine according to claim 1, wherein turning corners in said passages from said inlet opening through to the outlet where the cooling gas is sent out to said scroll machine proper, at which turning corner the direction of cooling gas flow changes, are rounded.

7. A scroll fluid machine according to claim 1, wherein a diverting means to divert cooling gas flow to the back side of a scroll disk and to that of the other scroll disk is provided.

* * * * *